US008584963B2

(12) United States Patent
Stefanutti et al.

(10) Patent No.: US 8,584,963 B2
(45) Date of Patent: Nov. 19, 2013

(54) SUPPORT STRUCTURE

(75) Inventors: Rino Stefanutti, Madrid (ES); Alvise Petrucco, Alcala de Henares (ES); Daniel Piloto, Alcala de Henares (ES)

(73) Assignee: Petrucco, S.A., Madrid (ES)

( * ) Notice: Subject to any disclaimer, the term of this patent is extended or adjusted under 35 U.S.C. 154(b) by 160 days.

(21) Appl. No.: 12/737,427

(22) PCT Filed: Oct. 20, 2010

(86) PCT No.: PCT/ES2010/070674

§ 371 (c)(1),
(2), (4) Date: Jun. 20, 2011

(87) PCT Pub. No.: WO2012/052571

PCT Pub. Date: Apr. 26, 2012

(65) Prior Publication Data

US 2012/0160123 A1 Jun. 28, 2012

(51) Int. Cl.
*E01B 3/00* (2006.01)
*E01B 29/05* (2006.01)

(52) U.S. Cl.
USPC ..... 238/26; 238/40; 104/2

(58) Field of Classification Search
USPC ..... 238/24–30, 40, 42, 50, 51, 287, 288, 238/292, 310; 104/2–5
See application file for complete search history.

(56) References Cited

U.S. PATENT DOCUMENTS

| | | | | |
|---|---|---|---|---|
| 1,674,893 A * | 6/1928 | Edson | 104/246 |
| 5,605,281 A * | 2/1997 | Benenowski et al. | 238/26 |
| 2012/0024970 A1 * | 2/2012 | Stefanutti | 238/26 |

* cited by examiner

*Primary Examiner* — R. J. McCarry, Jr.
(74) *Attorney, Agent, or Firm* — Paul Bogdon

(57) ABSTRACT

Temporary support structure that provisionally supports the railroad tracks (12) with traffic during the execution of works below the track, such as the jacking of a reinforced concrete box (13) for elimination of a level crossing.

12 Claims, 4 Drawing Sheets

SUPPORT STRUCTURE

OBJECT OF THE INVENTION

This invention generally refers to a temporary railroad support structure while works are being executed below the railroad tracks with traffic, without interrupting the rail service during mounting, dismounting and execution of the works.

STATE OF THE ART

It is known in the state of the art that to eliminate a level crossing on railroad tracks, a box structure is jacked outside the level crossing to be eliminated.

While the box jacking works are being executed, a railroad track support infrastructure is needed to permit train traffic.

The temporary support infrastructure is made by placing a series of rails parallel to the railroad track, which are supported on cross beams, i.e., the cross beams and the support rails are connected underneath.

The support rails are supported on the ends of the cross beams and, by means of a mechanical connection system, the ends of the cross beams are connected to the support rails.

A longitudinal prop is executed on both sides of each rail of the railroad track, which consists of placing bundles of rails parallel to each track rail, secured by a flange on both sides of the track rail and braced by the perpendicular or cross beams which make both bundles of rails work together, and at the same time bearing the train traffic load at the time when, because of work needs, the ballast support disappears.

Sometimes wooden wedges have to be placed between the cross supports and the track sleepers; these serve to ensure a correct levelling or banking of the track during jacking of the box structure.

Therefore, the mounting and dismounting works for the temporary support are laborious and require very long traffic stoppage times; with this system it is necessary to significantly reduce the traffic speed throughout the works execution period, creating a major interference with normal railroad traffic.

SUMMARY

This invention seeks to solve or mitigate one or more of the drawbacks indicated above by means of a support structure, as claimed in claim 1.

One object is to provide a support structure to temporarily support a section of railroad track with traffic during the execution of works below a track; where the support structure comprises one support beam per rail of the railroad track, installing it on the external side of the respective track rail; at least one cross beam, installing it between two consecutive railroad sleepers and housing each end of the cross beam in a clearance hole of the support beams, respectively; where the clearance holes of the support beam are distributed in the support beam web, and at least two steel profiles are located in the web area that separates two consecutive clearance holes, mechanically connecting the flanges of the same side of the support beam.

The ends of the cross beam are housed in the corresponding cell of the support beams, with the seating cells of the cross beam serving this purpose, such that a first means of mechanical positioning is inserted inside respective bore holes of the steel profiles adjoining the cell in which is housed the end of the cross beam and an extended hole located in the web of the cross beam.

BRIEF DESCRIPTION OF THE FIGURES

A more detailed explanation of the invention is provided in the following description and is based on the accompanying figures, where.

DETAILED DESCRIPTION OF THE INVENTION

Figure 1:
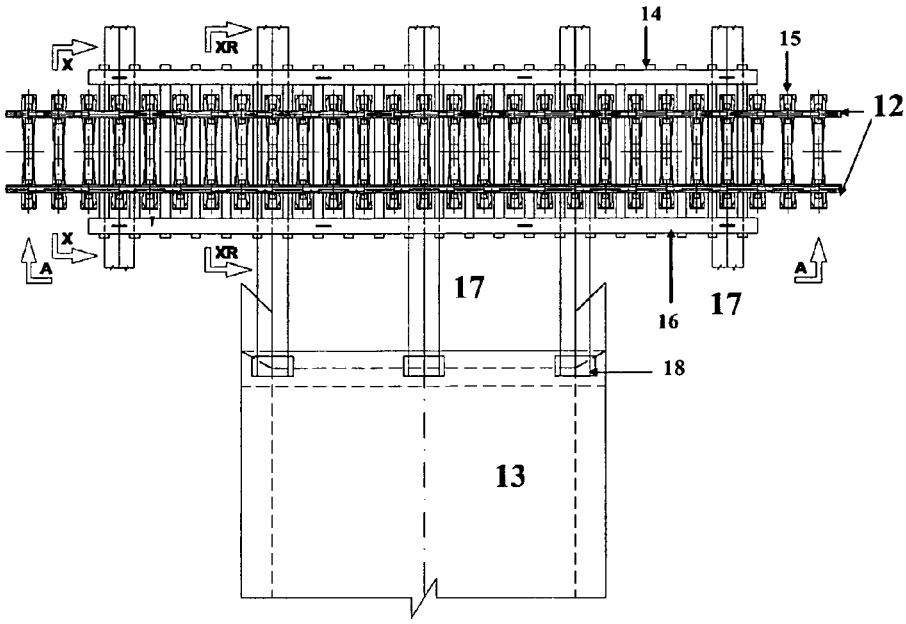
FIG. 1 shows a plan view of a temporary support structure below which a reinforced concrete box is jacked.

Following is a description, with reference to FIG. 1, of a temporary support structure that provisionally supports the railroad tracks 12 with traffic during the execution of works below the track, such as jacking of a reinforced concrete box 13 for eliminating a level crossing.

The support structure comprises various cross beams 14 that are arranged below the rails or cords of the railroad track 12 and parallel to its sleepers 15, in the jacking direction of the jacked box 13, such that the loads of the railroad rolling stock are transferred to various support beams 16 or longitudinal reinforcement beams externally parallel to the rails of the railroad track 12, i.e., between the two rails of the railroad track 12 no beam or rail is installed.

Figure 3:
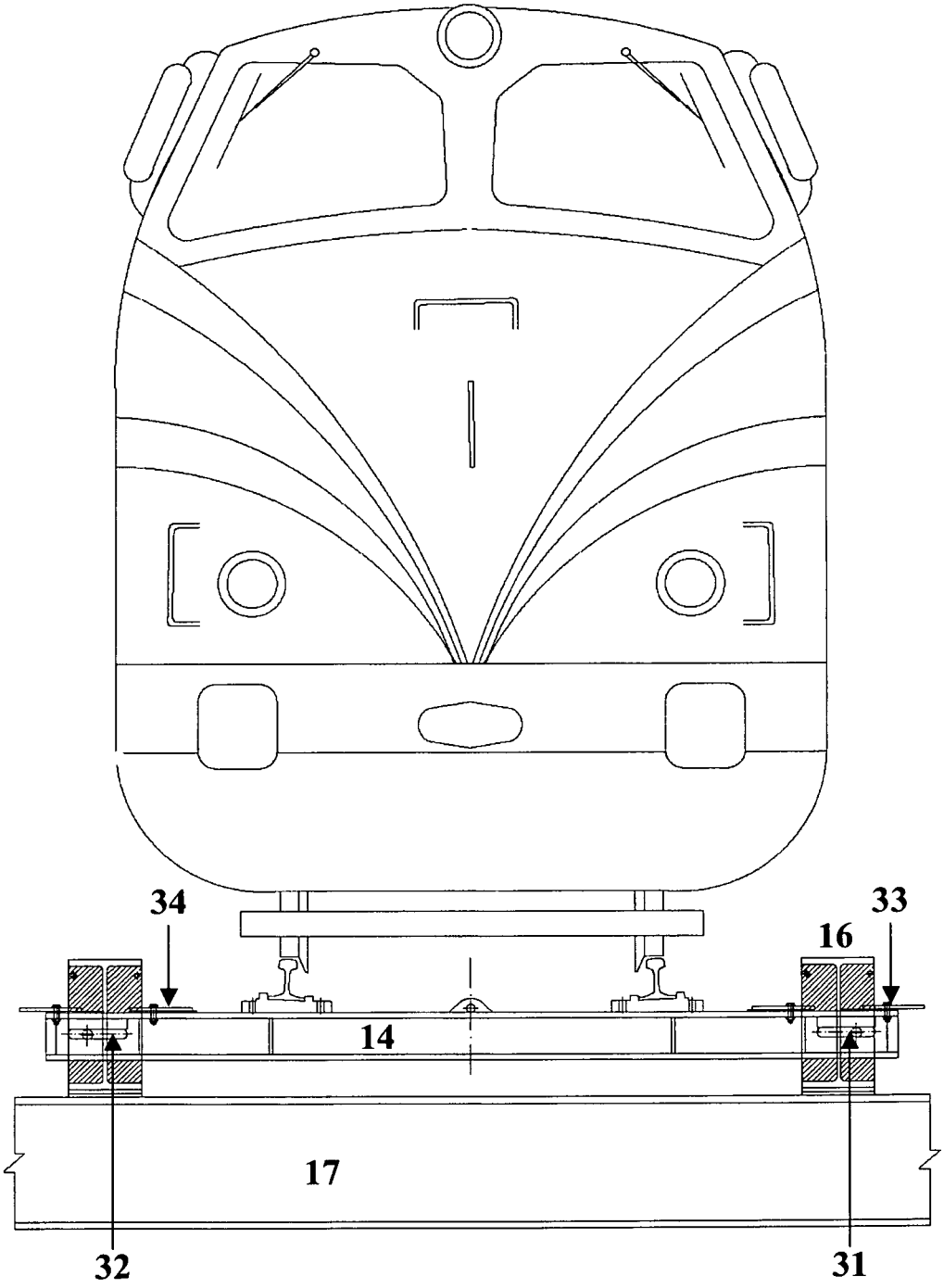
FIG. 3 shows an elevation view of a cross section XR-XR of the temporary support structure.
Figure 4:
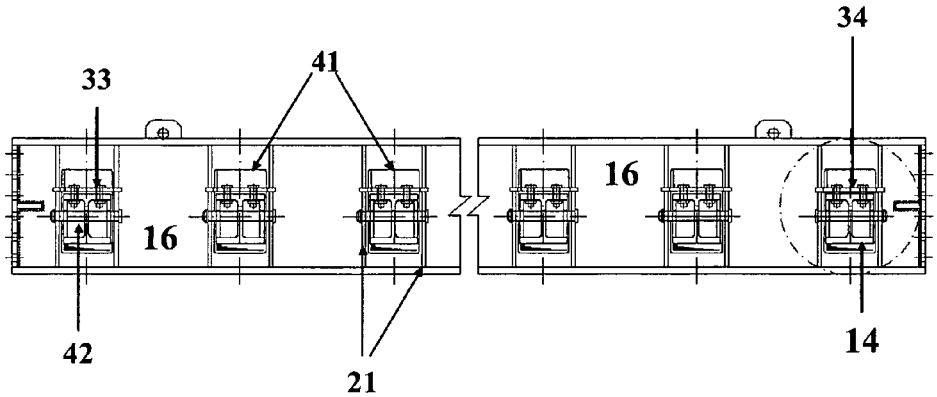
FIG. 4 shows an elevation view of a section A-A of a support beam.
Figure 5:
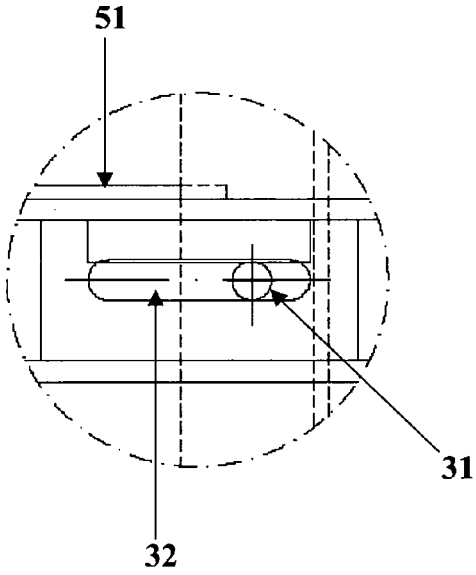
FIG. 5 shows a detail of a first means of mechanical positioning relative to the securing of vertical loads.
Figure 6:
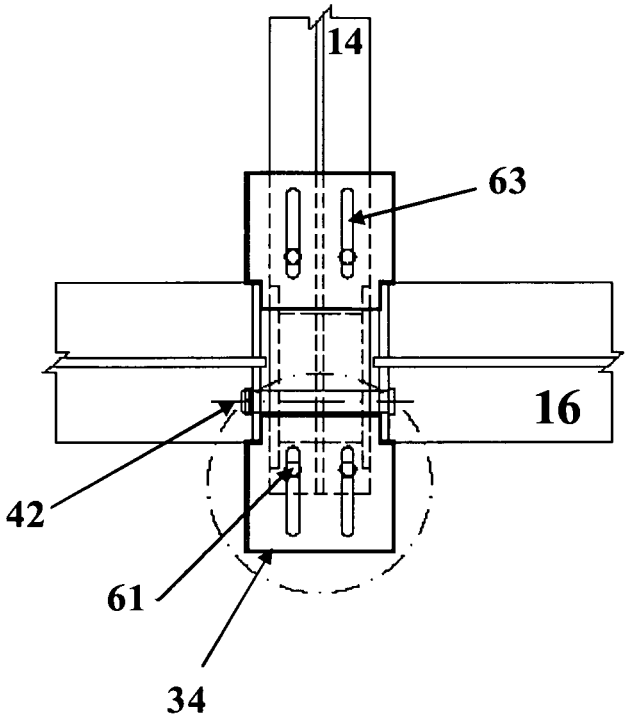
FIG. 6 shows a detail of an anti-sliding system for a cross beam to secure horizontal loads.
Figure 7:
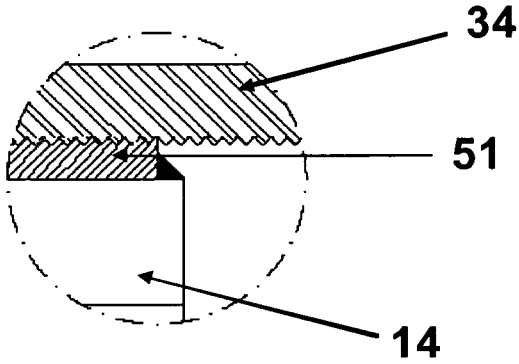
FIG. 7 shows a second detail of the anti-sliding system for a cross beam for horizontal loads.

In relation to FIGS. 3 and 5, the cross beam 14 comprises flanges and a web, i.e., it is an I-beam. The web of the cross I-beam 14 comprises some extended holes or mounting holes 32 at each end of the web to facilitate mechanical connection and fastening between the cross beam 14 and the support beams 16. For example, HEB 180 type beams will be used as cross beams 14.

In relation to FIGS. 2 to 6, the support beam 16, i.e., main load bearing beams, also comprises flanges and a web in which a series of clearance holes 41 or cells are longitudinally distributed, and various metal profiles or strips 21 perpendicular to the flanges and that mechanically connect the flanges and the web. For example, reinforced HEB 550 type beams will be used as support beams 16.

Each strip 21 comprises a bore hole 31 whose location depends on the location of a mounting hole 32 at the end of the cross beam 14, since a first means of mechanical positioning 42, such as a position pin in the form of a rod, a pin, a bolt, stud, etc., is inserted into the hole 31 of a first strip 21 of a support beam, in the mounting hole 32 of one end of a cross beam 14, and in the hole 31 a second strip 21 to secure the relative position between the cross beam 14 and the support beams 16.

Consequently, there are two strips 21 in the area of the web that separates two consecutive cells 41, each of which is next to a cell 41, respectively, to shorten the work span of the position pin 42.

Obviously, if the support beam 16 comprises a high number of cells 41, a high number of cross beams 14 can be housed and, therefore, the support provided by the mounted temporary support structure will be greater and, consequently, the railroad track 12 will be better immobilized.

The dimensions and distribution of the cells 41 inside the web of the support beam 16 depend on the dimensions of the cross beams 14 that are housed in them and on the relative position of the cross beams 14 between the sleepers 15. The cells 41 may have a circular, hexagonal, octagonal or similar shape, which is adapted to the seating function of the cross beam 14.

Therefore, the ends of the cross beams 14 are supported on the cells 41 of the support beams 16, i.e., the cells 41 serve as seating for the ends of the cross beams 14.

The cross beam 14 is a beam of the I-, II-, double T-profile type, etc. Likewise, the support beam 16 also has an I-, II- or similar profile.

The installation of the cross beams 14 requires a simple cleaning operation of the ballast existing between the sleepers 15 of the railroad track 12 without affecting the seating ballast of these sleepers 15; therefore, the function of the latter is not affected during the mounting work nor is it necessary to replace them with others, and it is even possible to immediately replenish the ballast between the sleepers 15 of the track 12 and the cross beams 14 without affecting the train traffic during the mounting and dismounting stages—both in terms of line traffic safety and travel speed—and they can be used with all kinds of railroad tracks 12 with any track width.

The support beams 16 are then placed in their mounting position, on the exterior of each rail of the railroad track 12, and the ends of the cross beams 14 are then housed in the respective seating cells 41.

Once the aforesaid task is completed, the position pins 42 are installed, and in this very simple manner the strong temporary support structure is mounted. For the dismounting process, the procedure is the reverse of the mounting procedure.

Figure 2:
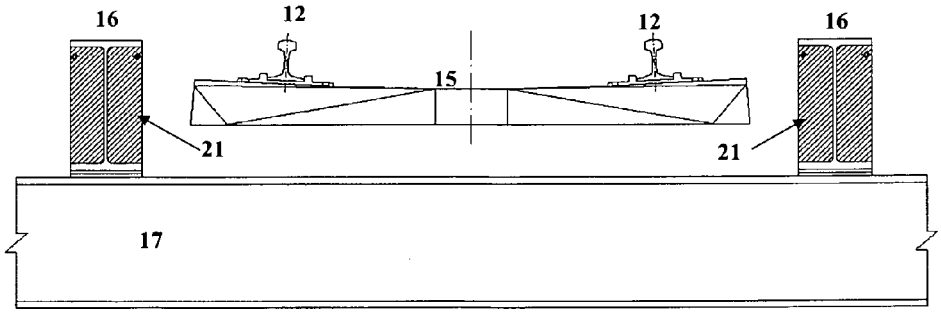
FIG. 2 shows an elevation view of a cross section X-X of the temporary support structure.

In relation to FIGS. 1 to 3, the load transmission system is designed so that all of the support structure elements form a grate that is capable of supporting the railroad track 12 and that transmits the railroad loads to some service beams 17, permitting the jacking of a box 13 under the tracks, which will perform the functions of the eliminated level crossing.

During the jacking operation of the box 13 or installation of the box in its final position, the support structure is supported by the steel service beams 17, parallel to the direction of jacking and sized and arranged to admit a free span of approximately 14 m. These service beams are originally supported at the farthest end on a foundation previously executed and supported on groups of micro-piles, and at the other end on the box itself by means of sliding supports 18.

The service beams 17 should bear all the railroad traffic loads under safe conditions and with admissible strains for the train traffic service on the railroad track 12.

During the transfer or jacking of the box 13 below the service beams 17, these beams 17 may transfer a relative sliding movement to the cross beams 14 with respect to the support beams 16.

In relation to FIGS. 3 to 7, to prevent any element of the support structure from sliding, this structure comprises an anti-sliding system that includes various first metal plates 51 mechanically fastened to the external face of the upper flanges of the cross beam 14 and distributed on both sides of the support beam 16; various bore holes 61 distributed in the first plates 51 and in the upper flanges of the cross beam 14 such that the support beam 16 is in between the bore holes 61 provided on the upper flanges of the cross beam 14; consequently, a bore hole 61 passes through the corresponding flange and the corresponding first plate 51; various second metal plates 34 for mechanical positioning on the external face of the first plates 51 by means of an anti-sliding profile, such as a saw-tooth profile, i.e., the upper face of a first plate 51 and the lower face of a second plate 34 are mechanically fitted together by the appropriate saw-tooth profiles; the second plate 34 comprises two extended holes or mounting holes 63 such that a second mechanical positioning system 33, such as a position pin in the form of a rod, a pin, a bolt, a stud, etc., is inserted into the hole 61 of a first plate 51 of a cross beam 14, in a mounting hole 63 of a second plate 34, to secure the relative position between the cross beams 14 and the support beams 16.

All the elements of the support structure are easily mounted and dismounted, and they are reusable thanks to their modular distribution for any length of track that needs to be reinforced and supported; therefore it costs less to restore the normal conditions of the track. It is not necessary to replace the sleepers because, from the beginning, they remain in their position.

The length of the support structure should be such that it permits the excavation required to move the box to be jacked. Consequently, to achieve the objective of supporting the track and transmitting the loads circulating on the railroad tracks, several support structures like the one described above can be placed adjacent to each other, since to obtain a better result the first longitudinal beams have a predetermined maximum length.

The embodiments and examples provided in this report are presented as the best explanation of this invention and its practical application, and thus allow experts in the technique to put the invention into practice and use it. Nevertheless, experts in the technique will recognize that the above description and examples have been provided for purposes of illustration and only as an example. The description as such is not intended to be exhaustive or to limit the invention exactly to that described. Many modifications and variations are possible in light of previous precepts, without digressing from the spirit and scope of the following claims.

The invention claimed is:

1. A method for temporarily supporting a section of railroad track including generally parallel rails (12) and generally parallel spaced sleepers (15) with traffic during the execution of works below the railroad track, comprising:

providing at least two spaced apart service beams (17) that are supported at their opposite ends;

installing a support beam (16) having parallel flanges and connecting web on the external side of each rail (12) of the railroad track;

the web forming part of the support beam (16) defining a plurality of cells (41);

installing at least one cross beam (14) between two consecutive railroad sleepers (15) and housing each end of the cross beam (14) in one of the cells (41) of the support beam (16);

locating at least two profiles plates (21) alongside the web of the support beam (16) that separates two consecutive cells (41);

connecting the support beam (16) to the cross beam (14) by mechanical positioning means extending through said profile plate (21) and the end sections of said cross beam (14) for transmitting railroad load to the service beams (17); and installing a jacking box (3) under the support structure (16) and the railroad track (12) for the excavation of the works below the railroad track (12) while the support structure is supported by the service beam (17) without interrupting the railroad traffic.

2. The method of claim 1, wherein each of the profile plates (21) defines at least one bore hole (31).

3. The method of claim 2, wherein the cross beam (14) includes a web and defines at least one extended hole (32) at each end of its web.

4. The method of claim 3, wherein each end section of the cross beam (14) is housed in a corresponding cell (41) of the support beam (16), with the cell (41) serving as a seating for the cross beam (14), further comprising:

inserting a first mechanical positioning system (42) into a bore hole (31) of the profile plate (21) adjoining the cell (41) which houses the end of the cross beam (14) and the extended hole (32) in that end of the cross beam (14).

5. The method of claim 3, wherein each end of the cross beam (14) is housed in a corresponding cell (41) of the support beam 16), with the cell (41) serving as a seating for the cross beam (14), further comprising:

inserting a first mechanical positioning system (42) into the bore hole (31) of the profiles (21) adjoining the cell (41) which houses the end of the cross beam (14) and the extended hole (32) in that end of the cross beam (14).

6. The method of claim 1, further comprising:

providing a plurality of first plates (51) on the external face of the upper flanges of the cross beam (14) and on both sides of the support beam (16);

providing a plurality of bore holes (61) in the first plates (51) and in the upper flanges of the cross beam (14);

providing a plurality of second plates (34) for mechanical positioning the upper face of the first plates (51) to the lower face of the second plates (34) by means of a plurality of anti-sliding profiles, and wherein each of the second plates (34) comprises at least two extended holes (63); and inserting a second mechanical positioning system (33) into a bore hole (61) of a first plate (52) and an extended hole (63) of a second plate (34) to secure the relative position of the support beam (16) between the cross beams (14).

7. A support structure to temporarily support a section of railroad track (12) including rails and spaced parallel sleepers (15) with traffic during the execution of works below the railroad track; characterized in that the support structure comprises:

elongated support beams (16) one each for each rail of the railroad track (12) installed on the external side of each rail;

each support beam (16) defining a cell (41) therethrough, each cell (41) disposed beneath the bottoms of the rails of the railroad track (12) with the cells (41) of the respective support beams (16) being generally aligned;

at least one elongated cross beam (14) installed between two consecutive sleepers (15), the respective opposite end sections of said cross beams (14) arranged in said cells (41) of the respective said support beams (16);

at least two plate means (21) secured to said support beam (16), one each located alongside said cells (41) of each support beam (16) for supporting said cross beam (14) within said cells (41);

each of said end sections of said cross beam (14) defining a longitudinally extending mounting hole (32) arranged within each of said cells (41);

said plate means (21) defining aligned bore holes (31) coplanar with said mounting holes (32) of said cross beam (14); and first mechanical positioning means (42) extending through said bore holes (31) and said mounting holes (32) for securing said cross beam (14) to both said support beams (16).

8. The support structure of claim 7 wherein each of said support beams (16) have generally parallel horizontal flanges and generally vertical webs; and wherein said cells are defined through said webs.

9. The support structure of claim 8 wherein said support beams (16) include a plurality of longitudinally spaced cells (41), the cells (41) of the respective support beams (16) being generally aligned.

10. The support structure of claim 7 wherein each said plate means (21) extends between and is secured to said flange of said support beam (16).

11. The support structure of claim 7 including an anti-sliding system comprising at least two longitudinally first spaced first plates (51), one each disposed on the respective upper end sections of said cross beam (14) and arranged on either side of each of said support beams (16); each of said plates (51) defining mounting holes (63) extending longitudinally of the upper flanges of said support beams (16); and wherein the upper flanges of said support beams (16) define bore holes (61) communicating with the mounting holes (63) of said plates (51) and including second mechanical positioning means extending through said mounting holes (63) and bore holes (61) for fixing the relative position of the support beams (16) and cross beam (14) preventing sliding between said beams (16, 14).

12. The support structure of claim 11 including at least one second plate (34) disposed on the upper surface of the end sections of at least one of said first plates (51) with the top of said first plate (51) and the bottom of said second plate (34) each having saw tooth surfaces fitted together.

* * * * *